US006082267A

United States Patent [19]

Cooper

[11] Patent Number: 6,082,267

[45] Date of Patent: Jul. 4, 2000

[54] ELECTRONIC, OUT-OF-LINE SAFETY FUZE FOR MUNITIONS SUCH AS HAND GRENADES

[75] Inventor: Edward F. Cooper, New Providence, Pa.

[73] Assignee: Bulova Technologies, L.L.C., Lancaster, Pa.

[21] Appl. No.: 08/943,926

[22] Filed: Oct. 3, 1997

Related U.S. Application Data

[60] Provisional application No. 60/041,478, Mar. 25, 1997.

[51] Int. Cl.[7] ..... F42B 27/00; F42C 11/02; F42C 15/34

[52] U.S. Cl. ..... 102/487; 102/209; 102/210; 102/254; 102/260; 102/262

[58] Field of Search ..... 102/209, 210, 102/218, 254–255, 256, 258, 260, 262, 482, 487, 488

[56] References Cited

U.S. PATENT DOCUMENTS

| | | | |
|---|---|---|---|
| 2,960,934 | 11/1960 | Jackson et al. . | |
| 3,618,522 | 11/1971 | Henderson | 102/487 |
| 3,756,157 | 9/1973 | England et al. . | |
| 3,823,669 | 7/1974 | Zacharin | 102/487 |
| 3,941,058 | 3/1976 | Gawlick et al. . | |
| 4,145,971 | 3/1979 | Graham et al. . | |
| 4,493,262 | 1/1985 | Hutcheson | 102/487 |
| 4,586,437 | 5/1986 | Miki et al. . | |
| 4,730,559 | 3/1988 | Brightman | 102/254 |
| 4,781,118 | 11/1988 | Assmann . | |
| 4,984,519 | 1/1991 | Ochi et al. . | |
| 5,040,463 | 8/1991 | Beaverson | 102/210 |
| 5,202,532 | 4/1993 | Haglund et al. . | |
| 5,245,926 | 9/1993 | Hunter . | |
| 5,335,598 | 8/1994 | Lewis et al. | 102/218 |
| 5,435,248 | 7/1995 | Rode et al. . | |
| 5,460,093 | 10/1995 | Prinz et al. . | |
| 5,485,788 | 1/1996 | Corney | 102/210 |
| 5,602,360 | 2/1997 | Sakamoto et al. . | |

FOREIGN PATENT DOCUMENTS

| | | | |
|---|---|---|---|
| 2483068 | 11/1981 | France | 102/487 |
| 1252098 | 10/1967 | Germany | 102/210 |
| 1268524 | 3/1968 | Germany | 102/210 |
| 2206646 | 8/1972 | Germany | 102/210 |

*Primary Examiner*—Harold J. Tudor
*Attorney, Agent, or Firm*—McDermott, Will & Emery

[57] ABSTRACT

A munitions fuze implements an operating mechanism comprising a piston, operating rod and toggle body bearing a detonator, aligned in a cavity within a munitions housing. In the safe condition the toggle body is out of line with a transfer lead and output booster arranged to charge an explosive when activated by the detonator. Overlying the piston is a primer and a piezoelectric device and primer that, when impacted by a striker produces pressurized gas for driving the piston and electricity for an electronic delay circuit. The piston moves the operating rod to bring the toggle body and detonator into alignment with the transfer lead and booster for detonation.

19 Claims, 4 Drawing Sheets

ELECTRONIC, OUT-OF-LINE SAFETY FUZE FOR MUNITIONS SUCH AS HAND GRENADES

RELATED APPLICATION

This application claims priority from provisional patent application Ser. No. 60/041,478, filed Mar. 25, 1997, entitled "AN ELECTRONIC, OUT-OF-LINE SAFETY REPLACEMENT FUZE FOR HAND GRENADE APPLICATIONS", which is incorporated herein by reference.

TECHNICAL FIELD

The present invention relates generally to munitions fuzes, and more specifically, to a munitions fuze that contains a novel electronic delay and out-of-line safety delay mechanism. The invention has particular applicability, but is not limited, to hand grenades.

BACKGROUND ART

For hand grenades, as with other explosive devices, it is important for detonation to take place only after a minimum time delay period has expired, as the explosive body must first be propelled or hurled out of an area of danger. Therefore, in a fuse for detonating a hand grenade it is important to precisely control the timing with which the explosive charge is initiated.

Conventional hand grenade delay mechanisms or fuzes have primarily been developed using a mechanical delay element operated by a spring or a pyrotechnic delay element operated by a pyrotechnic delay column. There are many inherent problems with such delay mechanisms, such as lack of long term storage stability, large dispersion of population delay function times, and difficulty in building a repeatable product.

Mechanical spring delay elements have the inherent disadvantage of being dependent on temperature and susceptible to aging. Conventional pyrotechnic delay elements are subject to inherent manufacturing variations with respect to density and type of chemical delay compositions contained therein, and therefore cannot be relied upon to provide highly accurate delay intervals. Flaws in the pyrotechnic delay column, difficult to detect, may result in rapid burn-through and considerable danger from unwarranted timing detonation. Employing quality control systems to detect such flaws during mass production of the pyrotechnic delay columns cannot be accomplished at a tolerable expense. In addition, pyrotechnic delay elements are susceptible to aging, as they lack long term storage stability.

Consequently, because of the inherent disadvantages of both mechanical spring and pyrotechnic delay elements, electric delay elements have been used to meet the stringent storage and uniform time delay requirements in the development of hand grenade fuzes. These electric hand grenade fuzes have typically comprised an electric energy source generator, an RC type electric delay circuit, and a trigger or threshold value switch capable of detonating the hand grenade when activated by the electric delay circuit.

Although the use of electric time delay elements in the manufacture of hand grenade fuzes can normally provide a more accurate time delay mechanism and are not as susceptible to temperature and long term storage degradation as the previously disclosed fuze designs, electric time delay elements possess the inherent disadvantage of being susceptible to inadvertent shorting or unwarranted electrical activation that can result in a potential hazardous detonation of the hand grenade in the field or even during manufacture.

Therefore, it is highly desirable to produce a safety mechanism that can prevent unintentional detonation of a hand grenade and yet maintain the time delay accuracy and long term storage advantages inherent in a hand grenade fuze employing electric time delay elements. It also is desirable for a hand grenade fuze possessing the added safety mechanism to fit within the typical hand grenade well and maintain similar operational characteristics as conventional grenade fuze designs. It further is desirable to produce a hand grenade fuze in which the fuze safety mechanisms must necessarily be correctly installed during manufacturing.

DISCLOSURE OF THE INVENTION

The invention provides an electronic out-of-line hand grenade fuze with both an electronic and mechanical safety mechanism to enhance the safety and reliability of hand grenades. In one aspect of the invention, an electronic out-of-line hand grenade fuze comprises an operating mechanism that is normally in a disarmed position and configurable into an armed position when displaced, a power generator coupled to the operating mechanism and capable of producing power for the fuze once the operating mechanism configures into the armed position, an explosive train, movable between in-line and out-of-line orientations in response to power produced by the power generator, and a detonator armed by the explosive train in response to movement of the explosive train between the in-line and out-of-line orientations. Preferably, an electronic circuit, powered by the power generator, includes a delay mechanism that is capable of supplying a detonation signal to the detonator at the appropriate time.

In accord with another aspect of the invention, an electronic hand grenade fuze comprises an operating mechanism that is normally in a safe position and configurable into an armed position when displaced, a primer assembly activated by the operating mechanism when the operating mechanism is configured into the armed position, and an electricity generator coupled to the operating mechanism for producing electricity in response to activation of the primer assembly. An electronic circuit is powered by electricity produced by the electricity generator, and a switch governed by the operating mechanism controls application of power to the electronic circuit. A detonator is armable by the primer assembly for detonation by the electronic circuit.

As another aspect of the invention, an electronic hand grenade fuze comprises a toggle body having in-line and out-of-line orientations. A detonator carried by the toggle body is armed when the toggle body moves between the in-line and out-of-line orientations. A breakable element maintains the toggle body in an initial orientation and an operating rod is capable of breaking the breakable element and moving the toggle body between the in-line and out-of-line orientations. A piston is aligned with the operating rod such that the piston, when advanced, is capable of driving the operating rod. An electricity generator has excited and non-excited states and is capable of producing electrical power when in the excited state. A primer assembly has activated and inactivated states and is capable of advancing the piston and exciting the electricity generator when in the excited state. An electronic circuit, powered by the electricity generator, comprises a delay mechanism that is capable of detonating the detonator. A slidably mounted safety lock initially is in a locked state limiting movement of the piston. The fuze includes further a striking component, and an operating mechanism normally in an unarmed position and configurable into an armed position when displaced to permit the striking component to activate the primer assembly and move the slidably mounted safety lock into an unlocked state.

BRIEF DESCRIPTION OF DRAWINGS

The present invention is illustrated by way of example, and not by way of limitation, in the figures of the accompanying drawings and in which like reference numerals refer to similar elements and in which.

BEST MODE FOR CARRYING OUT THE INVENTION

Figure 1:
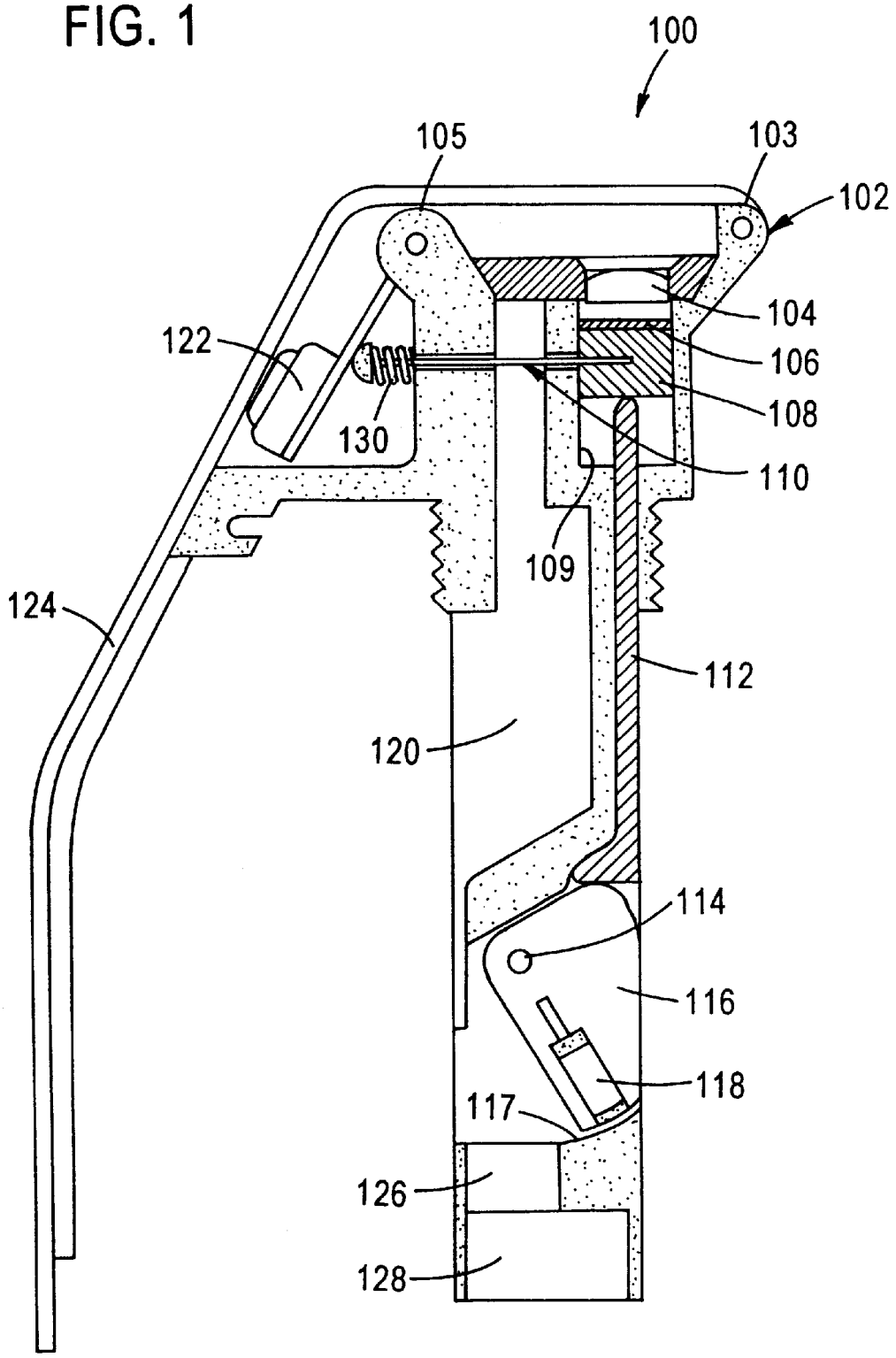
FIG. 1 is a perspective view of an electronic out-of-line hand grenade fuze in accordance with the present invention.

The invention to be described hereinafter is an electronic, out-of-line fuze, of particularly applicability to hand grenades, in which electronic and mechanical safety mechanisms are combined to enhance the safety and reliability of the fuze. Referring to FIG. 1, the fuze 100 comprises a zinc die cast housing 102, machined to form internal cavities such as cavity 120 for retaining operational subassemblies, and establishing an electrical ground for circuitry carrying out delay and detonation control functions as hereinafter described. The fuze 100, depicted in FIG. 1 in an unarmed, or safe, condition, comprises an operating lever 124 that is mounted to fuze housing 102 at a pivot 103 that preferably is constructed to enable the operating lever when released to pivot and then separate from the housing. The lever 124 is retained in the safe position depicted in FIG. 1 by a lever release pin (not shown) when the fuze is unarmed. With the operating lever 124 in the safe position, the operating lever overlies and retains a striker 122 that is mounted to the fuze housing 102 at a pivot 105. Beneath striker 122 is a safety pin 110 that extends through an aligned pair of bores in fuze housing 102 and into a piston 108 that rides within a piston bore 109 in the fuze housing. With the pin 110 engaged with the piston 108 as shown, the piston is locked in position near the top of bore 109. A spring 130 on the shank of the pin 110, outside and in contact with the surface of fuze body 102, mechanically biases the pin toward striker 122.

Between piston 108 and an overlying primer assembly 104 is an electricity generator 106 in approximate axial alignment with the piston and primer. Beneath and in contact with piston 108 is an operating rod 112 extending axially downward in the fuze housing 102 to a toggle body 116, formed of zinc die cast. The toggle body 116 is mounted to the fuze housing 102 by a shear pin 114. The shear pin 114 orients the toggle body 116, and the toggle body itself is configured, so as to cause the toggle body to attain the depicted safe position within the fuze body 102 during manufacture. In other words, the toggle body 116 is forced into the safe position, out of axial alignment with operating rod 112 and the components underlying the toggle body 116 when the toggle is assembled into the fuze.

Shear pin 114 is breakable, but of sufficient rigidity and strength to reliably retain the toggle body in the initial safe position shown, until intentionally rotated clockwise by downward movement of operating rod 112 upon fuze activation, as will be discussed later.

The toggle body 116 carries a detonator 118 that initially is out of alignment with an underlying transfer lead 126 and output booster 128. The detonator 118 may comprise an M100 or other appropriately sized device having the capacity to create a shockwave front capable of activating transfer lead 126 and output booster 128. Detonator 118 requires approximately 4,000 ergs of electrical energy, and is the most sensitive device among detonator 118, transfer lead 126 and output booster 128, together comprising an explosive train.

The transfer lead 126 accepts the detonator explosive output and produces high order function by building an explosive event to a sufficient energy level for booster initiation. This energy is sufficient to cause the booster to function high order. Transfer lead 126 is made from any suitable material determined to produce negligible risk of explosion due to any credible input stimulus.

Booster 128 accepts the output stimulus from the transfer lead 126 to function high order. The booster continues to build the explosion propagation event, producing sufficient energy to a hand grenade bursting charge (not shown) to cause the bursting charge to function high order. The booster 128, like lead 126, is made from any material determined to produce negligible risk of explosion due to any credible input stimulus.

The electricity generator 106, which preferably is an electrostatic device formed of a piezo-electric material, has one terminal connected directly to the top of piston 108 that itself establishes an electrical connection with fuse housing 102 and electrical ground. The opposite surface of the piezo electric device terminates in a flexible connection, penetrating the housing to make electrical contact with an electronics assembly to be described later. The opening is sealed with a filler material capable of withstanding the gas pressure and temperature normally encountered in a fuze. When the fuze 100 is in the safe condition shown in FIG. 1, the electronics assembly is maintained inactivatable as a result of grounding of the detonator 118 through the fuze housing 102, and disabled by an electrical switch (not shown in FIG. 1) in cavity 120 or elsewhere in the fuze housing that is maintained open by striker 122 while the striker is held by operating lever 124 in the cocked position.

Although electricity generator 106 is a piezoelectric device in the preferred embodiment, other sources of electricity can be implemented. For example, although not shown, electricity generator 106 may be implemented electromagnetically. As one example, an electromagnetic electricity generator in the form of a coil and DC magnet may be employed. A magnetic circuit is established by a permanent magnet which will be positioned with respect to a coil such that lines of flux pass through the coil but no electricity is introduced in the coil while the permanent magnet is stationary. However, upon abrupt movement of the magnet or coil in response to impact by striker 122, a rapid drop in magnetic flux in the coil will result in a transient electric current induced in the coil, to be captured and stored by appropriate circuit components.

As another electromagnetic implementation, the reluctance of a magnetic circuit could be abruptly changed to induce electricity. For example, the brisance of primer 104 used to initiate the fuze will shatter part of the magnetic circuit. This will force an abrupt reduction in magnetic flux cutting the coil. Gas pressure from the primer 104 could separate pieces of the magnetic circuit, changing the magnetic circuit reluctance and creating an accompanying drop in magnetic flux cutting the coil. This change in magnetic flux will produce electricity to be captured and used by the grenade fuze circuitry.

Figure 2:
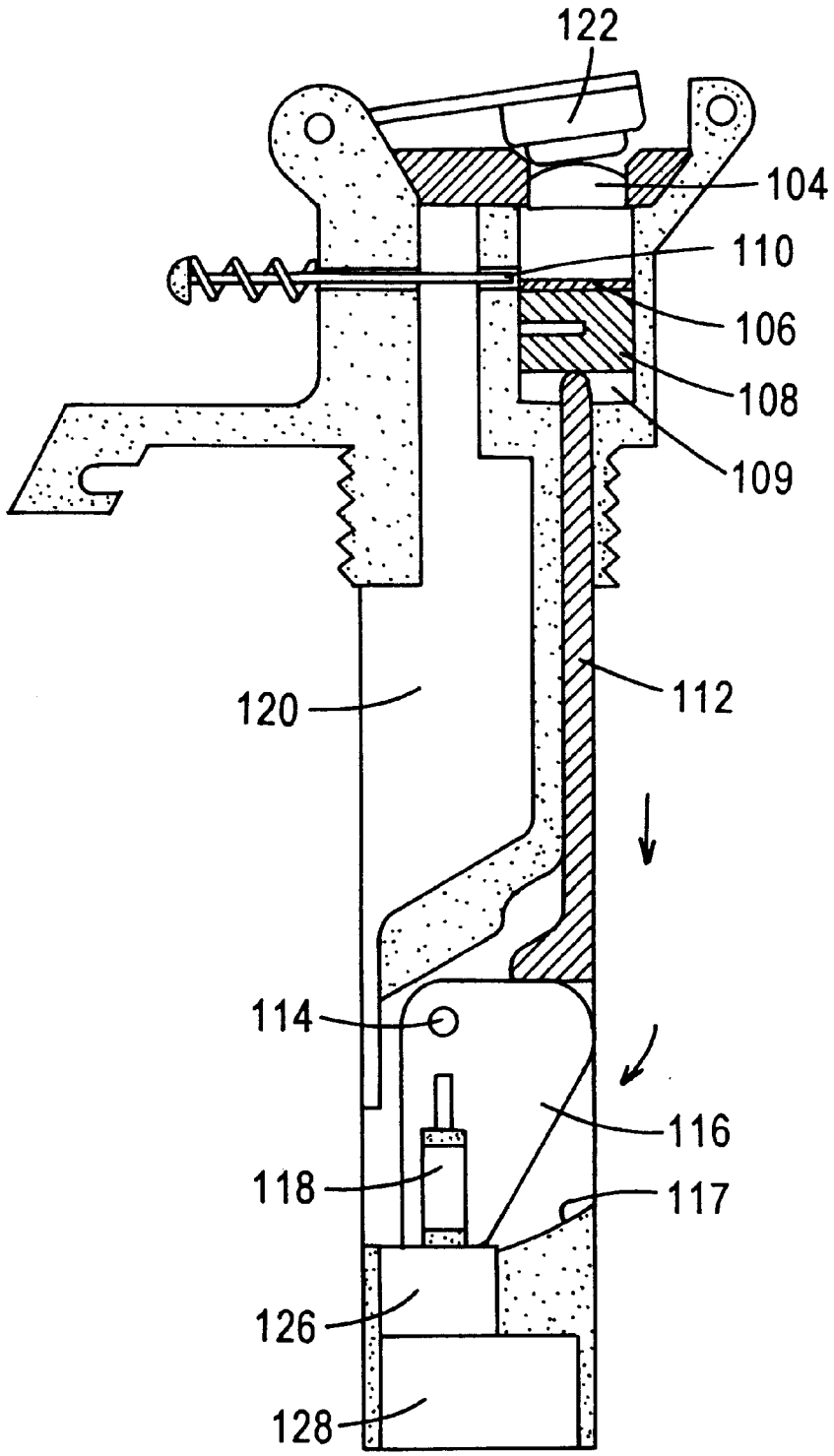
FIG. 2 is a perspective view of the hand grenade fuze in the armed state.

FIG. 2 depicts the fuze 100 armed and activated. The lever release pin (not shown) has been manually removed, releasing operating lever 124 which has pivoted clockwise from the position shown in FIG. 1 and then ejected as the user releases the grenade toward the target. Ejection of the operating lever 124 allows the spring driven striker to rotate clockwise, impacting primer 104, as shown in FIG. 2. As the striker 122 rotates, pin 110 releases from piston 108 under the force of spring 130. When the striker 122 hits the primer 104, the primer propagates a shock front from the explosion of the energetic material contained in the primer. The shock front from the primer 104 activates the electricity generator 106 that supplies operating power to the electronics assembly. The inertial mass of the piston prevents the piston from moving until the electricity generator has transferred most of its available energy to the electronics assembly. This delay typically will be on the order of 5 milliseconds.

When striker 122 moves into the armed position, shown in FIG. 2, the electrical switch it controls closes to permit the electronics assembly, now powered by electricity generator 106, to operate.

In addition to activating electricity generator 106, gas pressure from primer 104 drives piston 108 downward within piston bore 109. The piston 108 in turn drives operating rod 112 downward, transferring the force of the expanding gas from primer 104 to toggle body 116. This force is sufficient to shear or break the shear pin 114 and forcibly rotate the toggle body clockwise, riding along an arcuate inner surface 117 of fuze housing 102, into the axial alignment with lead 126 and booster 128 as shown in FIG. 2. In this position, detonator 118 is in contact with transfer lead 126, establishing a continuous path through the explosive train. When activated by the electronics assembly, the detonator 118, transfer lead 126 and output booster 128 will detonate the hand grenade.

Figure 3:
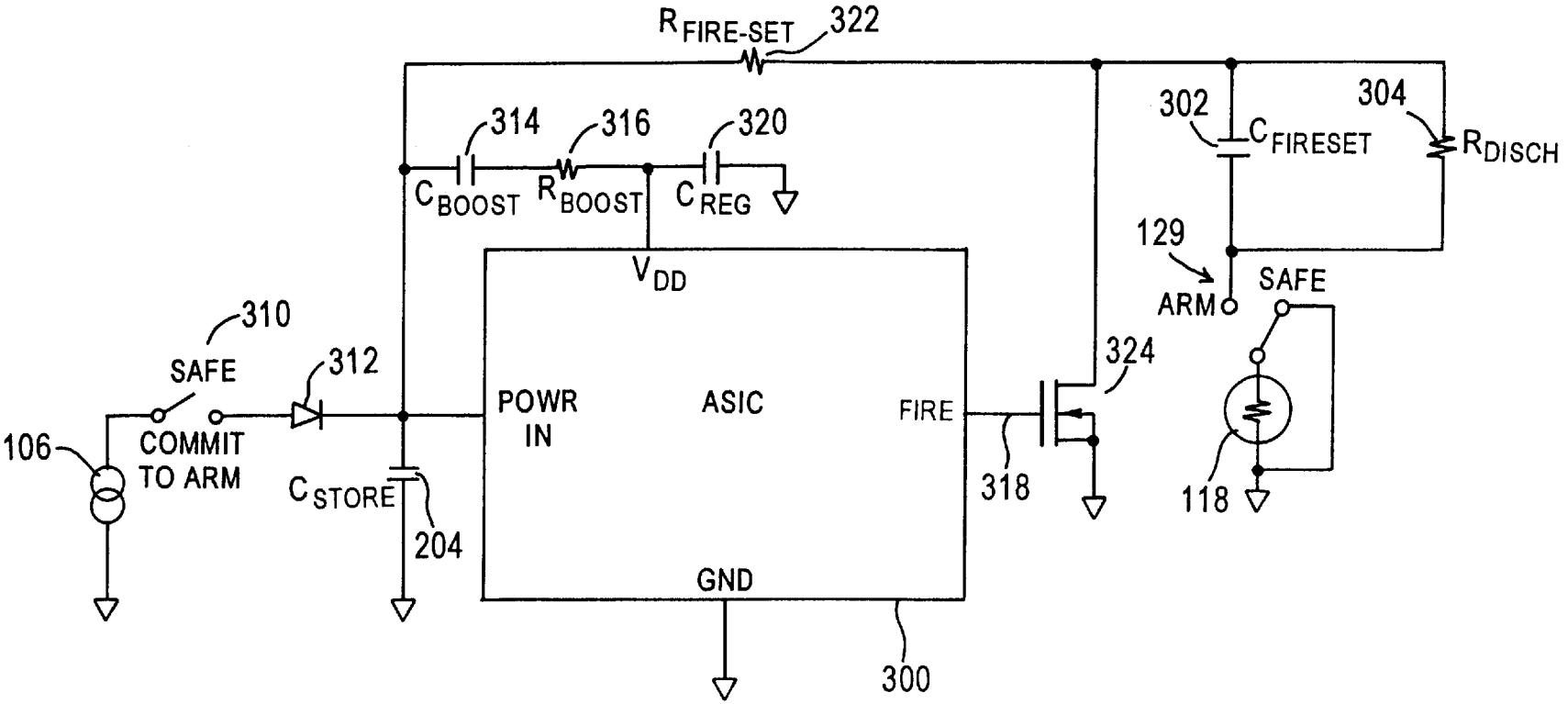
FIG. 3 is a high level schematic block diagram of the timing electronics implemented according to an embodiment of the invention.

After the fuze is manually activated by the user, detonation must be delayed by a precisely controlled interval in order to enable the grenade to have been propelled by a distance sufficient prior to detonation, to avoid injury to the user. Referring to FIG. 3, depicted is a schematic diagram of an embodiment of a timing circuit that may be incorporated in the electronics assembly, to impart a precise delay to the detonation sequence. In FIG. 3, block 300 designates a delay circuitry that preferably is provided at least partly in the form of an application specific integrated circuit (ASIC) type integrated circuit, although circuitry in other forms is acceptable.

Delay circuitry 300 has a GND terminal connected to fuze housing 102 that forms a system ground, an operating voltage terminal VDD for receiving operating power, a power-in terminal and a fire output terminal. Electrical power is provided to delay circuit 300 by electricity generator 106, through a switch 310 operated by the striker 122, described previously, and a diode 312. The diode 312 directs current from electricity generator 106 through switch 310, when closed, to a storage capacitor 204. The striker switch 310 is open when the fuze 100 is in the safe condition, shown in FIG. 1, and closed when armed (FIG. 2). Discharge of electricity from generator 106 into capacitor 204 establishes a capacitor terminal voltage sufficient to initiate the delay circuit at the power-in terminal and, through capacitor 314 and resistor 316, to supply operating power to the delay circuit 300. Capacitor 314 and resistor 316 comprise a boost circuit to quickly charge capacitor 320, minimizing circuit start up time. Capacitor 320 is an ASIC voltage regulator output capacitor.

Also connected to capacitor 204 and diode 312 is a fire-set resistor 322 that supplies current from capacitor 204 to the fire-set capacitor 302. Capacitor 302 charges during the delay interval to provide firing energy when the fire signal, terminal 318, is asserted. Transistor 324, connected to the "fire" terminal 318 at the output of circuit 300, is turned off in the safe condition. In the safe condition, the detonator 118 is shorted to ground by switch 129 associated with toggle body 116. When armed and upon expiration of the delay produced by delay circuit 300, transistor 324 is turned on by the "fire" terminal 318 of circuit 300. The switch 129, now in the arm position as a result of rotation of toggle body 116, establishes a current flow path from capacitor 302 to and through detonator 118.

RC circuit 322, 302 imparts a delayed supply of current to detonator 118 (approximately 1–2 seconds) to establish a safe distance between the grenade and user in the event of a timing malfunction associated with delay circuit 300 or a mechanical armory malfunction. The value of resistor 322 is selected to maintain current flow through capacitor 302 and detonator 118 below the no-fire limit of the detonator.

Resistor 304 provides additional safety by creating an independent discharge path for the energy stored in the firing capacitor 302. If a fuze were to fail to fire, any energy contained on the firing capacitor 302 would dissipate in the bleed resistor 304. Additionally, the bleed resistor 304 will also deplete any energy remaining on the storage capacitor 204 of a dud munition.

Figure 4:
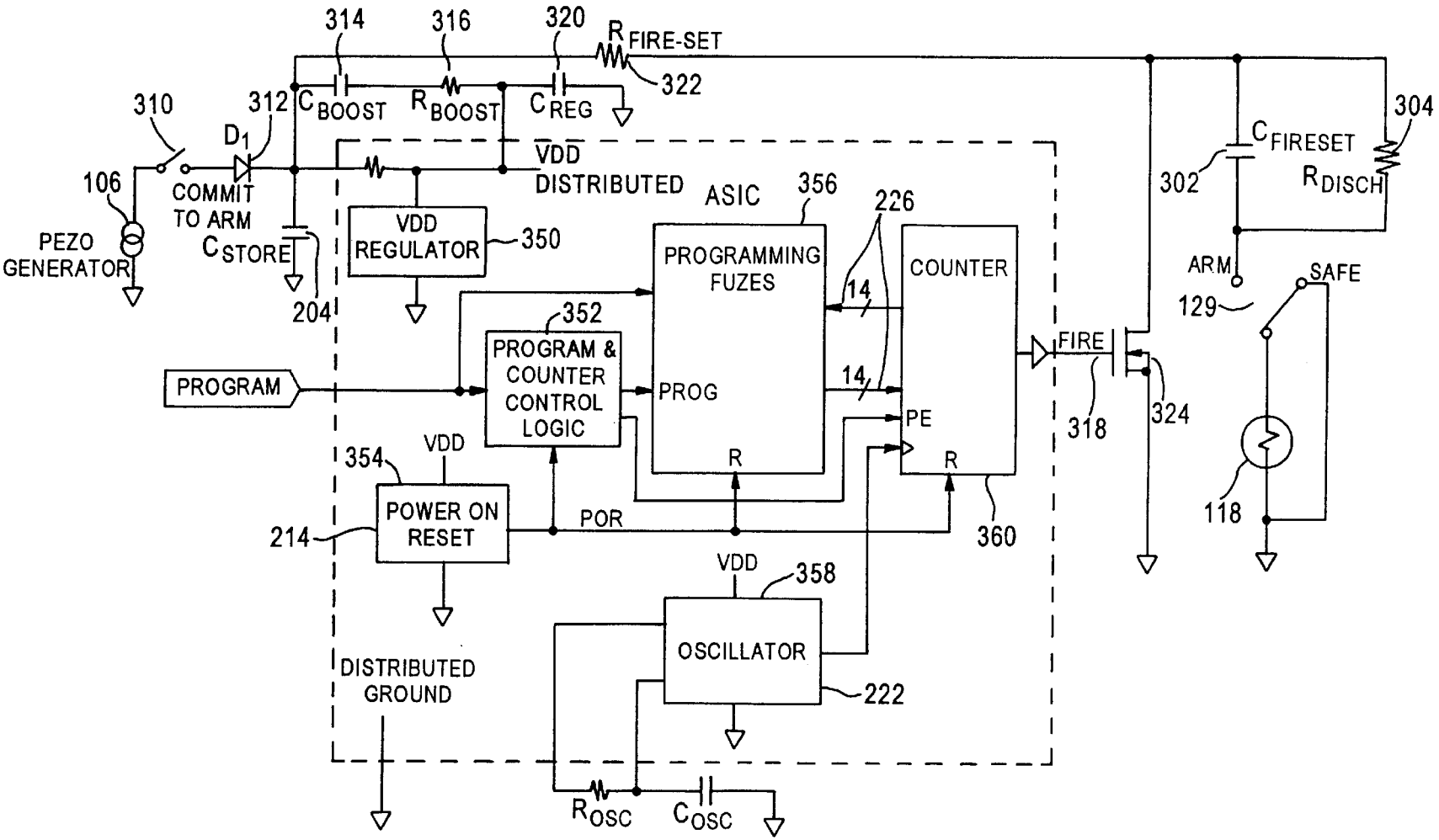
FIG. 4 is a more detailed schematic block diagram of the electronic delay circuit shown in FIG. 3.

Delay circuit 300 is shown in more detail with reference to FIG. 4. A regulator 350 stabilizes the operating voltage derived from capacitor 204 for distribution to the remaining components within the delay. These components include a control logic unit 352, a power on reset circuit 354, an array of programming fuzes 356, an oscillator 358 and counter 360 interconnected as shown.

Upon power-up when a commit to arm is generated, with switch 310 closed and electricity generator 106 activated, the power on reset circuit 354 initializes logic 352, fuses 356 and counter 360. The counter 360, under control of logic unit 352 and upon initialization, attains a prescribed count corresponding to data stored in the programming fuzes 356, which data may be factory preset. When the counter 360, synchronized to oscillator 358, counts down at the oscillator frequency to zero, the counter issues a fire command at output 318 that will turn on output transistor 324 and establish a current flow path from firing capacitor 302 to and through detonator 118, to detonate the device.

To recapitulate the operation of fuze 100, the user first removes the operating lever pin, not shown, from the grenade and throws the grenade toward the intended target. As the user releases the grenade, the handle is ejected allowing the spring driven striker 122 to impact primer 104. As the striker 122 rotates, the pin 110 ejects under the force of spring 130, releasing piston 108. When the striker hits the primer 104, the primer explodes and propagates a shock front to activate electricity generator 106 which charges storage capacitor 204. Piston 108 is driven downward by gas ejected from primer 104, driving operating rod 112 to rotate toggle body 116. The toggle body 116 breaks integral shear pin 114 and aligns detonator 118 with lead 126 and output booster 128. That is, the operating mechanism that includes piston 108, rod 112 and toggle body 116, initially out-of-line with transfer lead 126 in the safe condition, becomes in-line upon commit to arm. Switches 310 and 129, initially open, are automatically closed to enable detonation of detonator 118.

There accordingly has been described a fail-safe electronic fuze that relies both on electronic and out-of-line safe and arm mechanisms to prevent unintended detonation. The instrumentality of electrical switches operated by striker 122 and toggle body 116, precisely controllable electronic delay circuitry and an out-of-line explosive train, establishes several levels of safety. Furthermore, the implementation of shear pin 114, together with shape and size of toggle body 116, and accurate inner surface 117 of fuse housing 102, makes assembly of the toggle body to the fuze housing possible only in the safe position depicted in FIG. 1. Hence, malassembly of the device is avoided.

Although the present invention has been described with reference to particular means, materials and embodiments, from the foregoing description one skilled in the art can easily ascertain the essential characteristics of the present invention and various changes and modifications may be made to adapt the various uses and characteristics without departing from the spirit and scope of the present invention as described by the claims that follow.

What is claimed is:

1. A munitions fuze, comprising an operating mechanism that is normally in a disarmed position and in an armed position when displaced; a power generator coupled to said operating mechanism for producing power when said operating mechanism is displaced into the armed position; and an explosive train having a portion that rotates substantially about an axis perpendicular to a longitudinal axis of said train between out-of-line and in-line orientations in response to power produced by said power generator, said explosive train including a detonator armed upon rotation of said portion of said explosive train between said out-of-line and in-line orientations, said operating mechanism comprising:

a slidably mounted safety pin retaining said explosive train;

a striker for activating said power generator;

said striker having a safe position retaining said safety pin and being displaced from said power generator; and a manually operated activation mechanism having safe and armed positions, wherein said activation mechanism, when in the armed position, permits said striker to active said power generator and release said pin from said explosive train.

2. The fuze of claim 1, wherein said detonator is non-armable until said explosive train moves between said out-of-line and in-line orientations.

3. The fuze of claim 1, wherein said operating mechanism further comprises:

a toggle body having a safe position and an armed position;

a breakable element maintaining said toggle body in a safe position;

an operating rod contacting said toggle body; and a piston having activated and inactivated states, wherein said piston, when in said activated state, drives said operating rod to break said breakable element and arm said toggle body.

4. The fuze of claim 3, wherein said safety pin engages said piston in the safe condition of the fuze.

5. The fuze of claim 3, wherein said detonator is unarmable while said toggle body is in said safe position.

6. The fuze of claim 1, wherein said slidably mounted safety pin is initially in a locked state restricting said explosive train from moving between said out-of-line and in-line orientations.

7. The fuze of claim 1, further comprising an electronic circuit powered by said power generator and including a delay circuit for producing a detonation signal;

said detonator disconnected from said electronic circuit until said toggle body moves between said out-of-line and in-line orientations.

8. A munitions fuze, comprising an operating mechanism that is normally in a disarmed position and in an armed position when displaced; a power generator coupled to said operating mechanism for producing power when said operating mechanism is displaced into the armed position; and an explosive train having a portion that rotates substantially about an axis perpendicular to a longitudinal axis of said train between out-of-line and in-line orientations in response to power produced by said power generator, said explosive train including a detonator armed upon rotation of said portion of said explosive train between said out-of-line and in-line orientations, said munitions fuze including:

an electricity generator having excited and non-excited states, wherein said excited state produces electrical power, and wherein said power generator includes a primer, that when activated, excites said electricity generator.

9. The fuze of claim 8, further comprising an electronic circuit powered by said electricity generator, wherein said electronic circuit includes a delay element and produces a detonation signal.

10. The fuze of claim 9, wherein at least some of the electronic circuit is implemented in an integrated circuit.

11. The fuze of claim 9, wherein:

said detonation signal has active and inactive states, wherein said detonation signal, when in the active state, operates said detonator;

the electronic circuit further comprising:

a counter for delaying the active state of said detonation signal; and an oscillator regulating the timing of said counter.

12. The fuze of claim 11, further comprising a safety delay element which establishes a minimum delay time for activating said detonation signal.

13. The fuze of claim 11, further comprising a preset circuit for presetting values into said counter when said electronic circuit is initially powered.

14. The fuze of claim 9, further comprising an electricity storage element for storing electrical power to operate said electronic circuit.

15. The fuze of claim 9, wherein at least some of the electronic timing device is comprised in an ASIC.

16. The fuze of claim 8, wherein said primer, when activated, produces sufficient energy for moving said explosive train between said out-of-line and in-line orientations.

17. The fuze of claim 8, wherein said detonator is non-armable until said explosive train moves between said out-of-line and in-line orientations.

18. A fuze, comprising:

a toggle body having respectively out-of-line and in-line orientations;

a detonator carried by said toggle body and becoming armed when said toggle body moves between said out-of-line and in-line orientations;

a breakable element maintaining an initial orientation of said toggle body;

an operating rod capable of breaking said breakable element and moving said toggle body between said out-of-line and in-line orientations;

a piston aligned with said operating rod such that said piston, when advanced, drives said operating rod;

an electricity generator, when excited, producing electrical power;

a primer, when activated, advancing said piston and exciting said electricity generator;

an electronic circuit, powered by said electricity generator, including a delay mechanism and detonating said detonator when connected thereto and activated;

a slidably mounted safety pin initially in a locked state limiting the movement of said piston;

a striking component; and a manually operated activation mechanism normally in an unarmed position and displaceable into an armed position, wherein said activation mechanism, when in said armed position, permits said striking component to activate said primer assembly and enables said slidably mounted safety pin to move into an unlocked state releasing said piston for movement.

19. The fuze of claim 18, wherein the toggle body, when in the out-of-line orientation, maintains the detonator in a safe position.

* * * * *